53-390 SR
10/15/85 XP 4,546,598

United States Patent [19]

Karpisek

[11] Patent Number: 4,546,598

[45] Date of Patent: Oct. 15, 1985

[54] STRETCH WRAPPING APPARATUS

[76] Inventor: Ladislav S. Karpisek, 86 Woodfield Boulevarde, Caringbah, New South Wales, Australia

[21] Appl. No.: 484,476

[22] Filed: Apr. 13, 1983

[30] Foreign Application Priority Data

Apr. 23, 1982 [AU] Australia ..... PF3728

[51] Int. Cl.[4] ..... B65B 53/00

[52] U.S. Cl. ..... 53/556; 53/390; 53/441

[58] Field of Search ..... 53/441, 556, 567, 390

[56] References Cited

U.S. PATENT DOCUMENTS

| | | | |
|---|---|---|---|
| 3,925,964 | 12/1975 | Birkenfeld et al. | 53/567 |
| 3,961,459 | 6/1976 | Wolske | 53/441 |
| 4,050,219 | 9/1977 | Higgins | 53/567 |
| 4,309,861 | 1/1982 | Karpisek | 53/390 |

FOREIGN PATENT DOCUMENTS

| | | | |
|---|---|---|---|
| 2230549 | 1/1975 | France | 53/567 |
| 2070549 | 9/1981 | United Kingdom | 53/567 |

*Primary Examiner*—Leonidas Vlachos

[57] ABSTRACT

Stretch wrapping apparatus comprising a puckering device and an expandible rectangular frame demountably supported on the puckering device. Belts on the puckering device are provided to feed a length of plastic film tube onto pillars on the expandible frame to form a puckered band as a sub-base supporting the belts is raised relative to the pillars. A drive housed in the puckering device disengagably connected to jacking means on the puckering frame is provided to expand the frame and stretch the band to a size such that the expanded frame and the puckered band thereon can pass freely over the article to be wrapped.

6 Claims, 15 Drawing Figures

Figure 1:
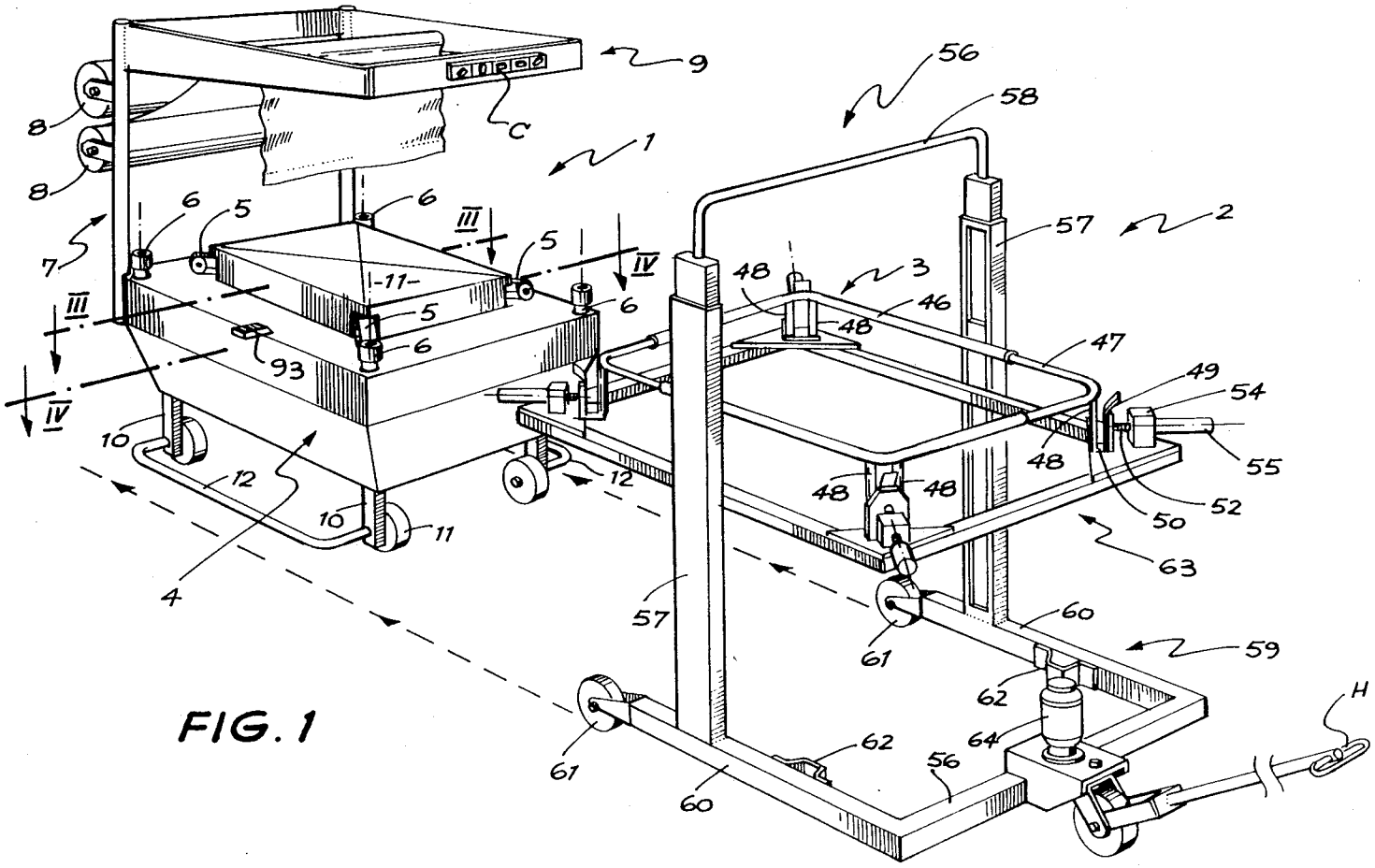

83
87
85
86
88
88
89
89
84
92
92
90
79
79a
71
80
74
83
77
76
78
63
70
81
75
73
60
68
69

80
79
79a
IX
83
77
76
78
71
72
80
74
81
75
73
70
60
68
69

83
77
88
88
89
92
76
90
91
78
63

STRETCH WRAPPING APPARATUS

This invention relates to apparatus to wrap an article or a group of articles in plastic film. There are several commercial methods each with its own apparatus for carrying out such wrapping operations.

One of the methods used is called shrink wrapping and it involves the use of a tube or bag of plastic film, the bag is "set" in an expanded condition in a cooling process as the tube is manufactured. The bag is passed over the article or group of articles to be wrapped as a loose cover and it is then released from the "set" condition by the application of heat. The plastic film shrinks as a result and the article(s) is enveloped in an elastically embracing plastic film sheath.

Machinery has been developed to assist in this process and an example of such machinery is shown in U.S. Pat. No. 4,063,401. The patent provides means for assembling a length of plastic film tubing as a loose gathered band of cross-sectional area greater than the article to be wrapped and then lowering to band to form a loose bag over the article. Heat is then applied, as by placing the article in an oven, to release the plastic from its "set". The plastic film shrinks onto the article to provide a protective cover.

This approach to the plastic wrapping problem has the great disadvantage that heat has to be used. As a result the integrity of the film cover can be destroyed if the heat is too great and the plastic melts. If the plastic melts it can adhere to the article being wrapped. It the article or articles to be wrapped are themselves plastic covered there is every possibility that the outer wrapping material will fuse to the article wrapping material. There is also the other problem that the products in the articles to be wrapped may be heat affected.

To overcome this above problems stretch wrapping has been developed. This involves wrapping the article ot articles in a bandage of plastic film whilst it is under tension. When the wrapping operation is finished the result is a tighty wound and slightly stretched plastic sheath which encloses the article. There are problems with this method such as maintaining the article stable whilst the tensioned plastic is wrapped around it. There is also the problem of rotating the article so it can be wrapped or rotating the roll of plastic film around the article as part of the wrapping process.

For the above reasons both the shrink and stretch wrapping methods have not been entirely successful.

The present invention overcomes the problems of both shrink wrapping and stretch wrapping outlined above and is quicker than either of the above known methods. There are other advantages which will be obvious from the following detailed description. The invention is primarily concerned with the apparatus to carry out the proposed wrapping method and accordingly the invention can be broadly said to comprise stretch wrapping apparatus comprising a puckering device and an expandible rectangular frame with curved corners demountably supported on the puckering device, the puckering device is for depositing a length of plastic film tube onto the expandible rectangular frame as a puckered band which band is then stretched by expanding the frame to a size sufficient to allow an article or group of articles to be stretch wrapped to pass freely through the frame and the band thereon; the expandible frame has a puckering plate assembly of generally U shape at each corner comprised of a puckering plate interconnected with a band support which are substantially parallel and in planes at right angles to that occupied by the expanding frame, the puckering plates lie outside the perimeter of the expanding frame and the band supports lie within the perimeter of the expanding flame, a jacking screw fixed to each puckering plate and extending away from the expanding frame with the longitudinal axes of the jacking screws in a common plane parallel to that occupied by the expanding frame, a drive assembly connected to each jacking screw with the drive assemblies all fixed to a support member, a drive shaft extending into each drive assembly and drivingly connected through the drive assembly to the jacking screw associated therewith; said puckering device comprising a base, a drive means on the base, four power take offs on the base driven by the drive means and releasably engaged by the respective drive shafts whereby the expanding frame is supported on the puckering device, a sub-base disposed above the base, sub-base elevating means connecting the sub-base to the base, drive means on the sub-base, a driving connection between the drive means on the sub-base and the elevating means, four movable puckering belt supports mounted on the sub-base, biassing means to spread the puckering belt supports to bring the puckering belts into contact with the respective puckering plates when the expandible frame is mounted on the puckering device, and puckering belt drives connected to the sub-base drive means.

Figure 2C:
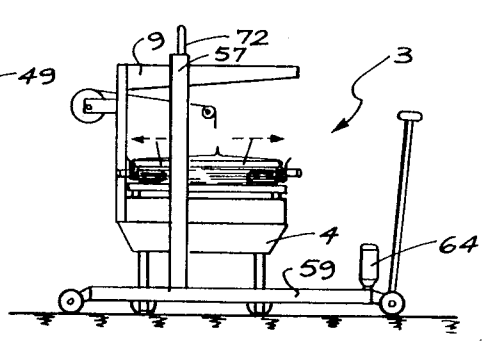
Figure 2B:
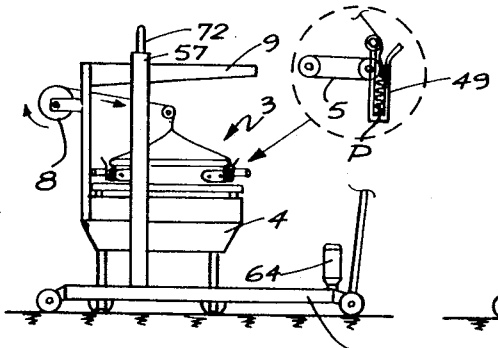
Figure 2A:
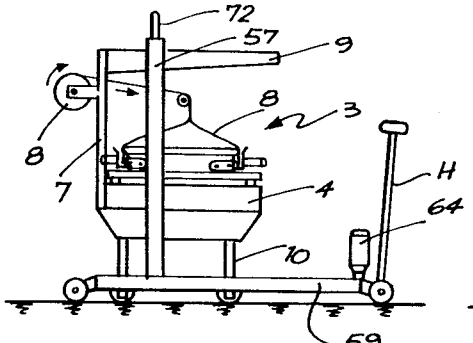
Figure 2F:
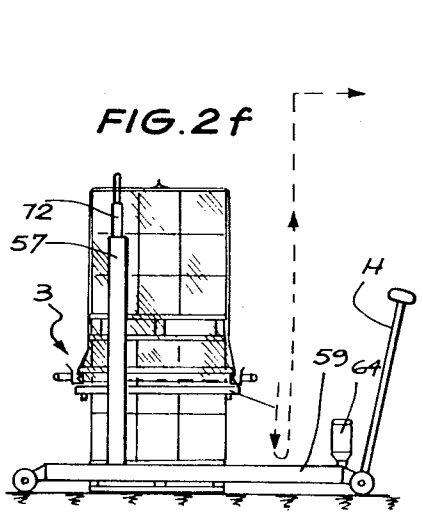
Figure 2E:
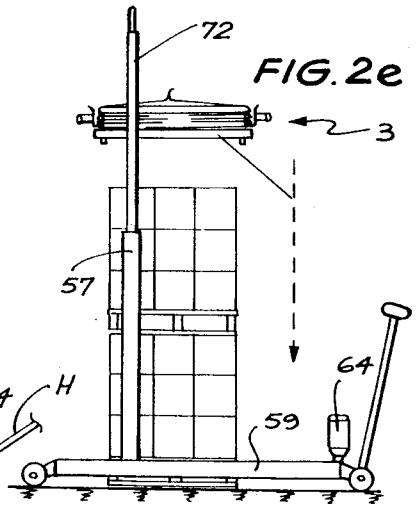
Figure 2D:
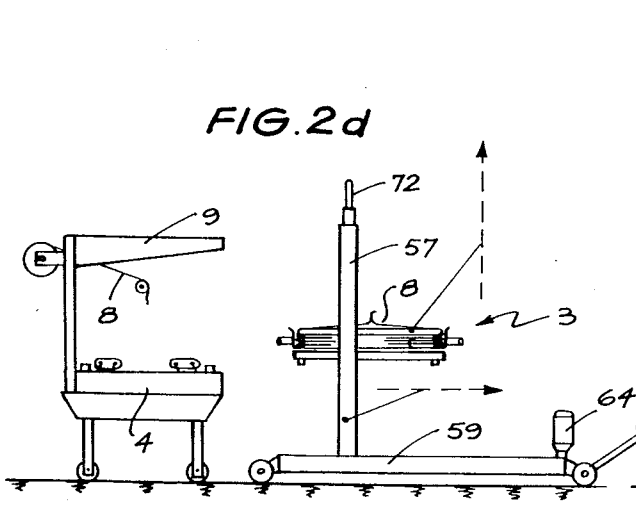
Figure 4:
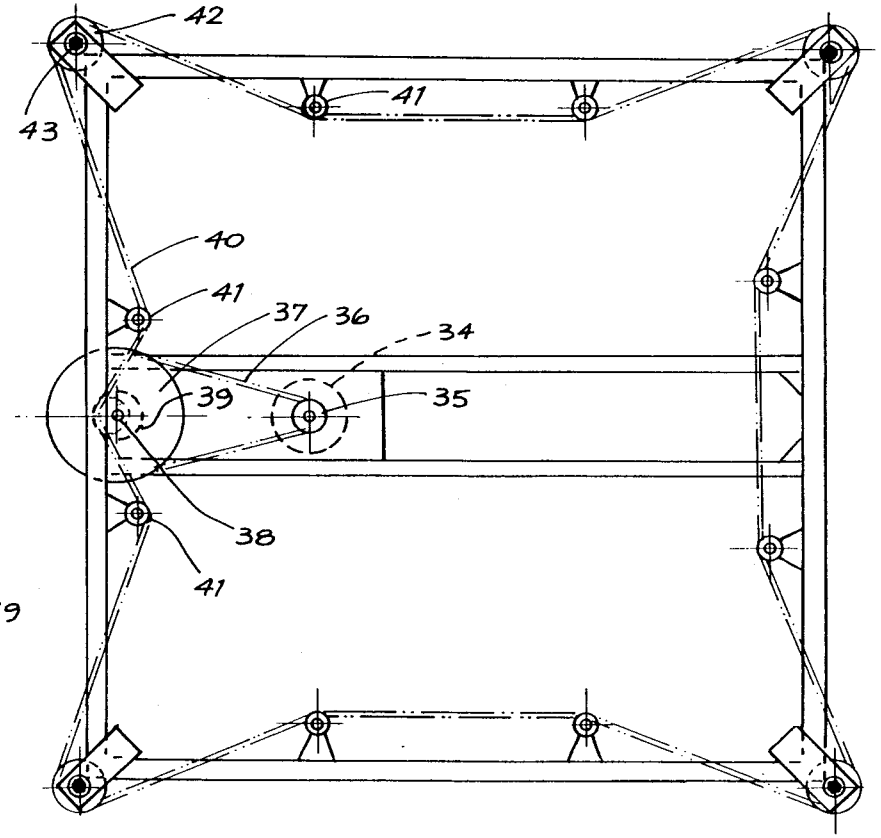
Figure 3:
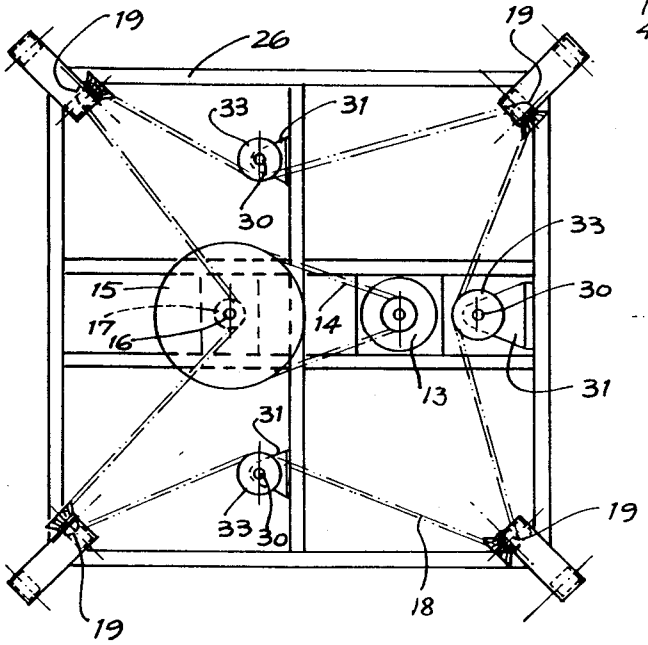
Figure 5:
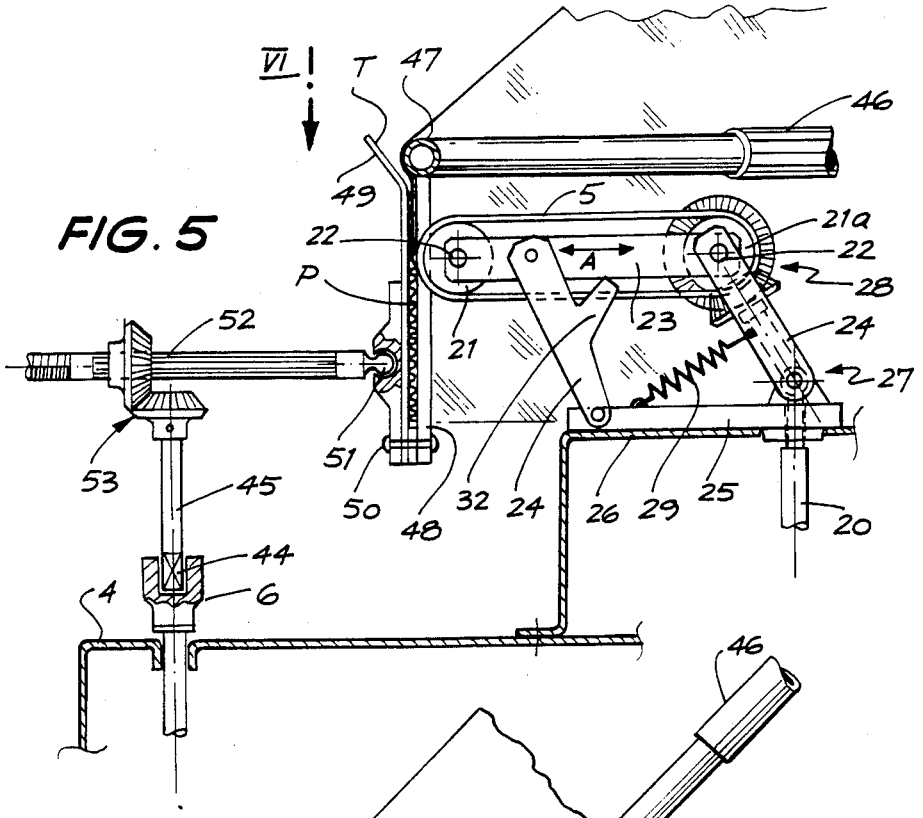
Figure 6:
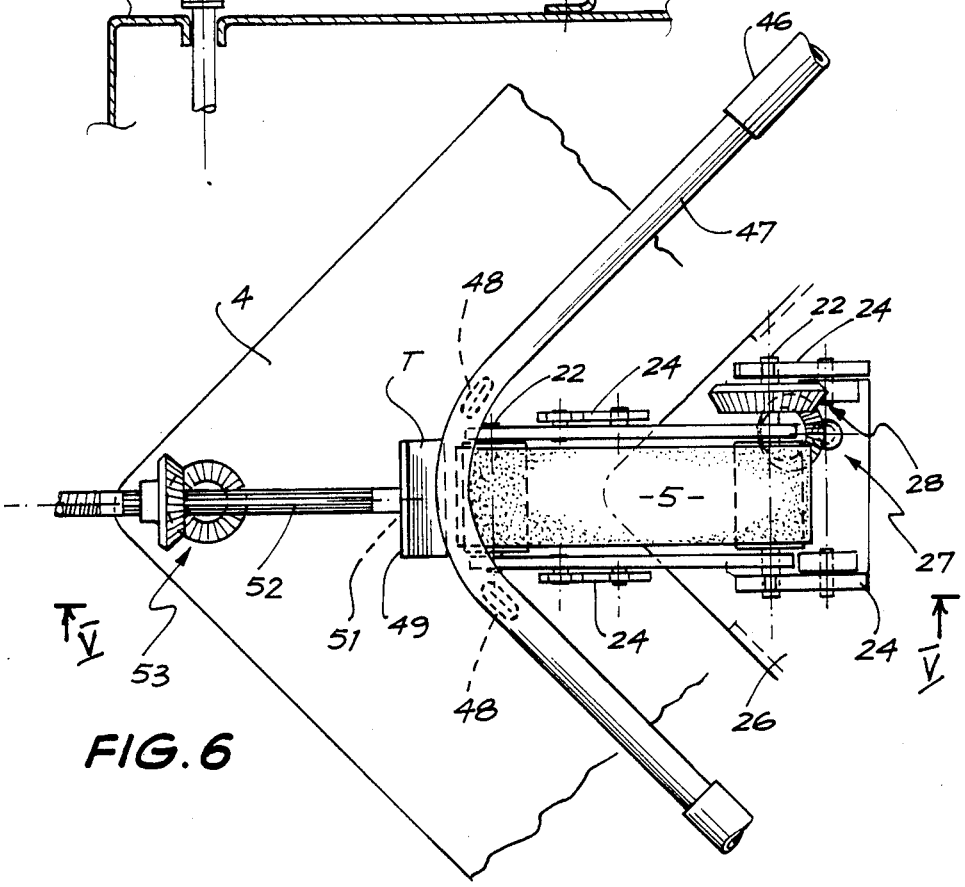
Figures 7, 8, 9:
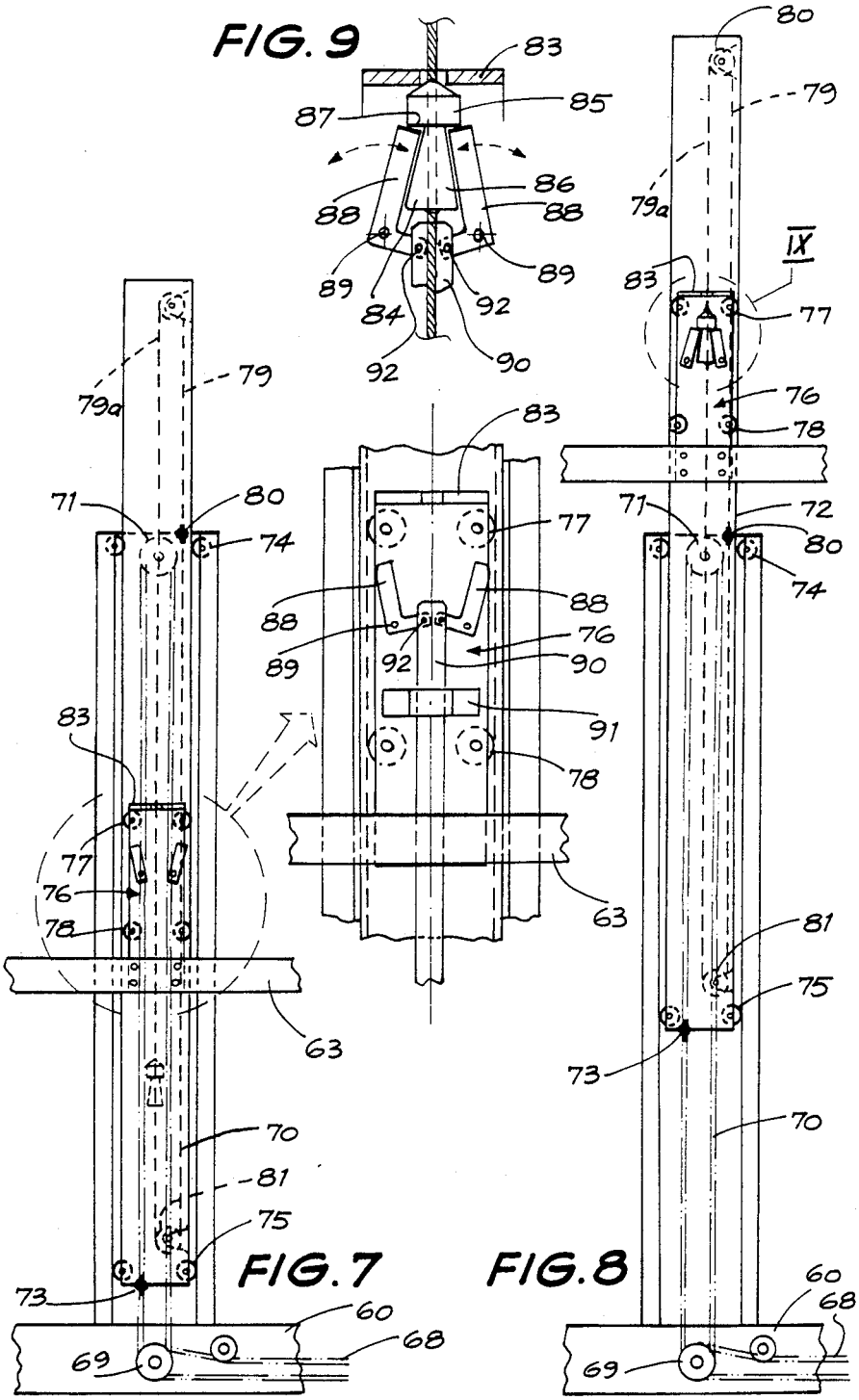
Figure 10:
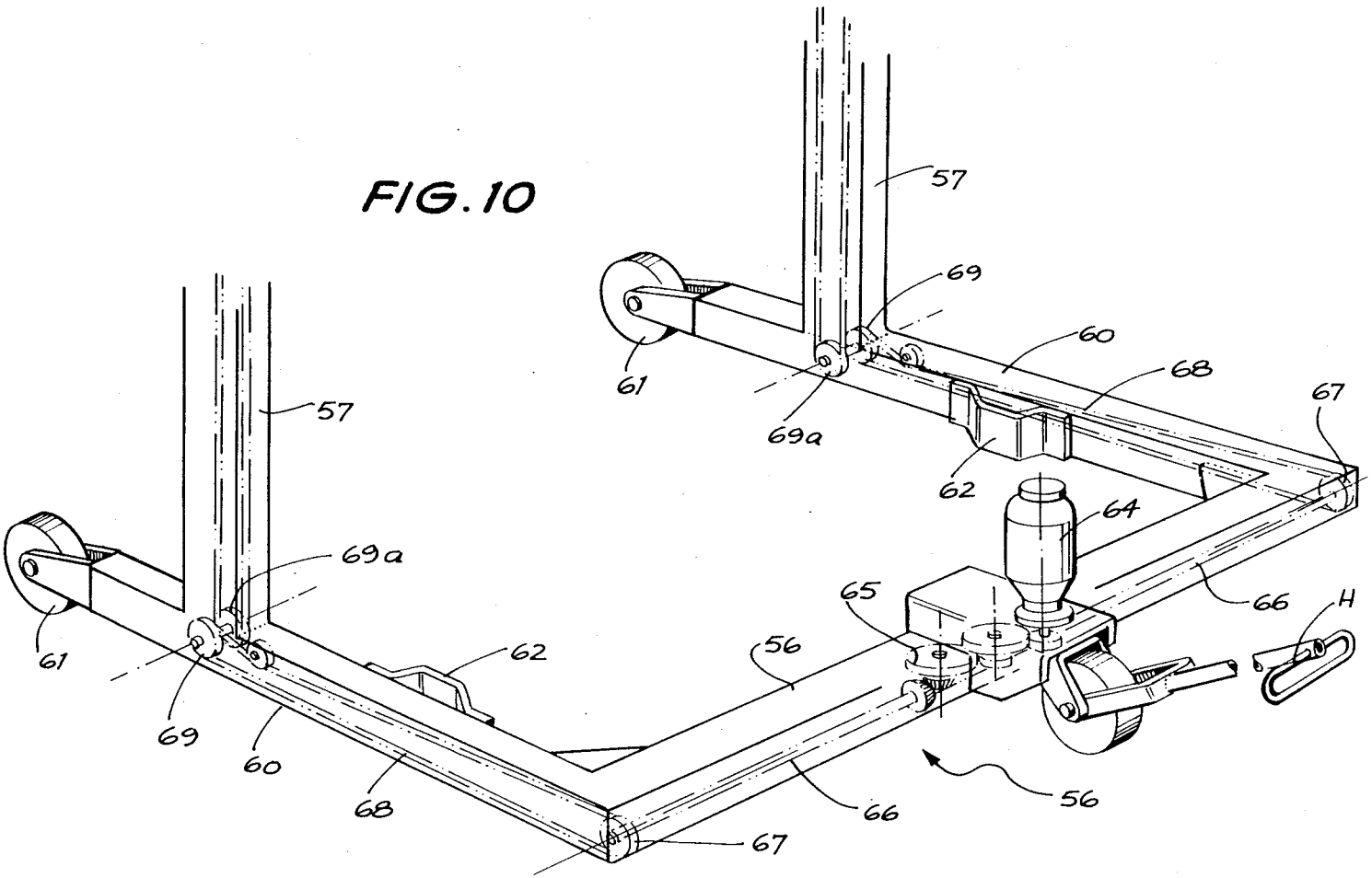

A presently preferred embodiment of the invention will now be described with reference to the accompanying drawings in which:

FIG. 1 is a perspective view of the apparatus of the invention including an optional transporter means to facilitate the stretch wrapping operation, FIG. 2*a* shows the apparatus of FIG. 1 in a first operation of puckering a length of plastic onto an expandible frame, FIG. 2*b* shows a later stage in the first operation as shown in FIG. 1, FIG. 2*c* shows the expansion of the expandible frame after the puckering operation has been completed, Fig. 2*d* shows the use of the optional transporter to move the expandible frame with its expanded band of plastic film to a use location, FIG. 2*e* shows the elevation of the expandible frame with its band of film to a position above the load to be wrapped, FIG. 2*f* shows the expandible frame in a lowering operation during which the expanded plastic film is stripped from the frame and shrinks onto the load being wrapped to form a tight sheath about the load, FIG. 3 is a schematic plan view of a sub-base assembly of the puckering device carrying the puckering belts, FIG. 4 is a schematic plan view of the base of the puckering device carrying drive means for the expansion of the expandible frame, FIG. 5 is sectional elevation on section line 5—5 of FIG. 6 of a corner assembly of the sub-base showing the inter-relationship of the puckering belt and the expandible frame, FIG. 6 is a plan view of a corner assembly, FIG. 7 is fragmentary elevation showing a transporter mast in a lowered condition, FIG. 8 is a fragmentary elevation similar to Fig. 7 showing the transporter mast in a raised condition, FIG. 9 is a fragmentary view of a driving dog arrangement whereby a trolley is raised relative to the tansporter mast, and FIG. 10 is a perspective view of the transporter with the upper portions of the masts removed.

As illustrated there is a puckering device 1 and a transporter 2 which has a puckering frame 3 mounted thereon so as to be movable from an operating position on the puckering device 1 to a use position over a load to be wrapped. The steps in the operation can be best seen from FIG. 2 and a detailed description of the stages shown in FIG. 2 will be given after a detailed description of the members 1 and 2.

The puckering device 1 broadly comprises a base 4 housing drive means for puckering belts 5 and frame expanding drive heads 6. There is a support frame 7 for rolls of plastic film 8 in the form of a gussetted tube, which may have transverse seal lines to convert the tube into a number of bags. The feed end of the film passes over guide means 9 so as to align it centrally over the base 4. The base 4 is supported on legs 10 each carrying a wheel 11 and there are guide rails 12 joining the front and read legs 10.

Below the cover 11 there is a sub-frame 26 supporting drive means for the belts 5 and the heads 6. The drive means can be best seen from FIGS. 3 and 4 and comprise a first motor 13 coupled through a belt 14 to an idler wheel 15 fixed to a shaft 16 arranged for rotation about a vertical axis in a baring fixed to the sub-frame 26. A small diameter sprocket 17 fixed to the shaft 16 is engaged in a chain 18 which passes around sprockets 19 on shafts 20 (see FIG. 5) to apply a drive to the belts 5 in the following manner.

Each belt 5 is supported on two pulleys 21 and 21*a* fixed to shafts 22 rotatably mounted in a pair of spaced apart members 23 each supported by a pair of links 24, all of the links 24 are connected to a member 25 fixed to the sub-frame 26. The members 23,24 and 25 thus provide a parallel link assembly which can move backward and forward in the direction of the arrow A. The belt 5 and the pulley 21*a* are preferably of toothed form. The shaft 20 drives the pulley 21*a* through a universal joint (not shown) but indicated generally as 27, and bevel gears 28. A spring 29 applies a biassing force for the parallel link assembly and a stop 32 by engagement with a member 23 limits the movement of the parallel link assembly in the spring biassed direction. There are four such assemblies, one at each corner of the base as will be seen from FIG. 1.

The sub-frame 26 is mounted on three jacking screws indicated 30 (see FIG. 3). The upper ends of the screws 30 are rotatably housed in bearings 31 fixed to the sub-frame 26 with collars on the screw preventing axial movement of the screws 30 in the bearings 31. The lower ends of the screws are housed in threaded holes in brackets fixed to the base 4. Fixed to each screw 30 there is a sprocket 33 around which the chain 18 also passes. It follows therefore that the motor 13 drives the pulley 15 through the belt 14 and the sprocket 17 drives the chain 18 which, through its engagement with the sprockets 19, drives the belts 5. The chains 18 through its engagement with the sprockets 33, rotates the jacking screws 30 to elevate the sub-frame 26 relative to the base 4 of the machine, or in the event the rotation of the motor 13 being reversed, lowers the sub-frame. The pitch of the threads on the jacking screws 30 and the ratio of the various sprocket sizes and the gearing between the bevel gears 20 is related so as to provide puckering characteristics to be discussed later.

The other drive means housed in the base 4 comprises a motor 34 with a pulley 35 fixed to the drive shaft, a belt 36 connects the pulley 35 to a pulley 37 fixed to a shaft 38 mounted for rotation about a vertical axis. A sprocket 39 fixed to the shaft 38 is engaged by a chain 40 which passes around idlers 41 and sprockets 42 on shafts 43, which are drivingly coupled to the driving heads 6. The form of the driving heads 6 is a cup to receive the driven ends 44 of shafts 45 forming parts of the puckering frame assembly 3. The preferred drive means is by two diametrically opposed dome ended lugs in the cup to engage with two diametrically opposed dome ended lugs on the shaft 45, the shape of the lugs and small arcuate spaced occupied by them facilitates the entry of the shaft ends 44 into the cups 6.

The puckering frame 3 is adapted to be mounted on the base 1. The frame 3 comprises two outer right angled tubular members 46 engaged telescopically by two like members 47, but of smaller diameter. The members 46 and 47 have corner mounted depending brackets comprised of two bars 48 spaced apart sufficiently to allow the belts 5 to enter therebetween. Behind the bars 48 there are puckering plates 49 connected to the bars 48 by ties 50. The inner faces T of the paltes 49 are teflon covered to provide minimal friction and the frame members 46 and 47 are coated, plated and/or polished for the same reason. It is to be noted that the outermost surfaces of the members 46 and 47 lie outside the planes occupied by the bars 48, see FIG. 1 and FIG. 6. This relationship has a bearing on the retention of a puckered mass of plastics material on the puckering frame after it is puckered. As will be understood the puckered material around the bars 48 would have to expand slightly to pass back over the members 46 and 47. If there was no requirement to expand, as would be the case if the members 46 and 47 were in the same planes as the bars 48, the plastic would "creep" over the members 46 and 47 in an effort to achieve the pre-stretched condition.

The plates 49 are coupled, as shown, by a ball and socket connections 51 to frame expanding screws 52 (see FIG. 5) which are coupled through bevel gears 53 to the shafts 45. The bevel gears are housed in grearboxes 54 and the shafts 52 are housed in protective tubes 55, (see FIG. 1). It is clear that as the chain 40 is driven by the motor 34 the drive through the heads 6 to the shafts 45 and 52 will result in the puckering frame 3 being expanded or contracted depending upon which direction of rotation of the motor 34 is chosen.

The puckering frame 3 includes a mounting frame having corner gusset plates to which the gearboxes 54 are fixed. The puckering frame is supported by two uprights 57 fixed to a U shaped frame 59. The two legs 60 of the frame 59 are end supported on wheels 61 and there are two locators 62 on the legs 50 to laterally centralise the arch frame 59 relative to the base 4 by engagement with the guides 12. The longitudinally locate the frame 59 there are abutment plates, not shown, on the mounting frame 63 which abut the uprights 7 of the plastic holding frame, see FIG. 1.

The uprights 57 telescopically house masts which are raised and lowered as follows, see FIGS. 7 to 10. The base part 56 of the U frame 59 supports motor 64 which, through gearing 65, drives shafts 66 rotatably supported in the base part 56. Sprockets 67 fixed to the shafts 66 are connected by chains 68 to sprockets 69 at the feet of the uprights 57. Endless chains 70 around sprockets 69*a* paired with the sprockets 69 pass up through the uprights 57 and around sprockets 71 at the upper end of the uprights. One run of each chain 70 is fixed to an inner mast 72 as at 73 so that as the chains 70 are moved the inner mast 72 will move up or down within the uprights 57 supported at the upper and lower ends by wheel sets 74 and 75 respectively. There is a wire rope connection between the inner mast 72 and a trolley 76 supported on wheel sets 77 and 78 engaged with the inner mast 72. The wire rope 79 is fastened at one end to the upper end of the upright 57 at 80 and passes downwardly around a pulley 81 on the inner mast 72. The wire rope then extends upwardly to pass around a pulley 82 at the upper end of the inner mast 72 and then downwardly where the other end of the wire rope is again fixed at 80 to the upper of the upright 57.

The upward run of wire rope 79*a* passes through a hole in a plate 83 on the trolley 76 and there is a lifter block 84 fixed to the wire rope run 79*a*. The block 84 has the shape shown in FIG. 9 with a pointed head 85 below which there is a reduced section portion 86 providing a shoulder 87. On the trolley 76 there is a pair of lever arms 88 of L shape pivoted so as to be movable as shown in FIG. 9 so terminal end portions of the arms can be positioned below the head 85 and can be pivoted to a position free of the head, as shown in the enlarged fragmentary view of portion of the trolley shown in FIG. 7. The arms are pivoted about the pivot pins 89 by a control rod 90 slidably mounted in saddle 91 on the trolley by means of pins 92 connecting the control rod 90 to the lever arms 88. The control rods 90 are moved in an upward direction, as the trolleys 76 descend, when the lowermost ends of the control rods 90 engage an abutment members 93 on the base 4.

The puckering frame raising operation involves initiating the operation of the motor 64. This causes the rotation of the sprockets 69–69*a* which will move the chains 70 and as the inner masts 72 are fixed to the chains 73 the inner masts 72 will be raised. Movement of the inner masts 72 will cause a shortening of the wire cables below the trolleys and lengthening of the cables above the trolleys which in turn causes the blocks 84 to move to a higher elevation where they will engage under the plates 83 thereby applying a lifting force to the trolleys. This causes the puckering frame fixed to the trolleys to be raised and the shafts 45 to disengage from the heads 6. The raising of the trolley is terminated when a desired elevation of the puckering frame has been achieved. It will be noted that as the trolleys rise the control arms 90 are raised free of the abutment members 93 allowing the control rods to move down and because of the arrangement of the lever arms connected thereto they will be pivoted about the pins 92 and the free ends of the lever arms will engage under the shoulders 57 of the lifter blocks 84.

In a lowering operation the motor 64 is operated in the opposite mode of rotation and the inner masts and trolleys fall due to gravity. However as a downward force needs to be applied to the puckering frame to strip the plastic therefrom in a wrapping operation, as hereinafter explained, the shoulders 57 of the lifter blocks 84 bear on the ends of the lever arms, as shown in FIG. 9. Disengagement of the shoulders 57 from the lever arms is arranged to occur just prior to the shafts 45 bottoming into the heads 6, this is achieved by the positioning the engagement elevation of the abutments 93 with the ends of the control rods. The inner mast is lowered for a short distance below the lifting block release position by the lever arms and an automatic interrupt of the power supply to the motor 64 can be achieved by a suitable limit switch. A like switch can be used to limit the up travel of the puckering frame.

Once the puckering frame is raised to clear the guard 11 the transporter can be wheeled by the handle H to a use location where the puckered plastic is placed over an object.

The manner of using the equipment just described is as follows. FIG. 2*a* shows the puckering frame in a working position over the puckering unit with the puckering frame released from the cables within the uprights 57 and the driven ends 44 of the shafts 45 of the gearboxes 54 located in the heads 6. Plastic is then unrolled from the roll 8 and the open end is located around the periphery of the puckering frame 3. The open end of the plastic is then drawn down over the puckering frame and caught between the belts 5 (which project between the bars 48) and the surfaces T of the puckering plates 49, see FIG. 2*b*.

By means of the controls C (see FIG. 1) the motor 13 is energised in a first direction which will cause the belts 5 to move in a downward driection, anti-clockwise as shown in FIG. 5, and at the same time the jacking screws 30 wil be rotated to cause the sub-frame to be raised relative to the base 1. The result is a series of puckers P, as shown in FIG. 5, which do not overlap. The rate of belt feed for puckering and the rate of sub-frame elevation is such that no overlap of puckers occurs. If overlap was to occur there would be difficulty in stripping the puckered plastic from the puckering frame.

Puckering is continued until a predetermined amount of plastic has been placed as a puckered band on the puckering frame 3 around the bars 48 and then the plastic on the puckering frame is severed from the poll plastic 8, see FIG. 2*c*. leaving a closed end of a plastic bag extending across the top of the puckering frame.

FIG. 2*c* also indicates the next operation which is to energise motor 34 to rotate the heads 6, the shafts 45 and 52 to expand the puckering frame to a predetermined size which is in excess of the cross-sectional size of the load on the pallet.

FIG. 2*d* indicates the transportation step which follows the raising of the puckering frame to release the ends 44 of the shafts 45 from the heads 6.

FIG. 2*e* indicates the puckering frame in a fully raised condition poised over a pallet and load prior to the commencement of the wrapping step.

FIG. 2*f* indicates to wrapping step during which the puckering frame is lowered, the plastic bag closed end over the top of the load causes the plastic to strip from the puckering frame as it descends thereby depositing the bag over the load. Immediately upon release from the stretching forces applied by the frame the plastic bag will commence to contract to try and achieve its unstretched condition. As the load on the pallet is greater in cross-section than the unstretched cross-section of the bag it will shrink onto the load where it will remain as a closely embracing skin around the load. The puckering frame is lowered until the plastic bag is completely stripped from the puckering frame and the length of the bag is preferably such that the terminal end of the bag will close over the edges of the underface of the pallet. To facilitate this and the stripping of the plastic bag from the puckering frame the pallet is preferably supported on a raised stand smaller in cross-section than the pallet.

After stripping the plastic bag the puckering frame is raised and returned to its start position over the base 1.

The controls of the puckering device and the transporter are integrated in the preferred arrangement of the invention and they are interconnected by an aerial cable extending from the top of the legs 7 to an elevated position on the transporter.

Whilst the use of a transporter has been described it will be understood that the puckering frame can be manually delivered to a use station. The use of a transporter is therefore to be considered a preferred manner of handling the puckering frame and not an essntial of the apparatus of the invention.

I claim:

1. Stretch wrapping apparatus comprising a first rectangular frame (63), a second rectangular, expandable and contractable frame (3), a holder (48,49) for a puckered band of plastic film at each corner of the second frame (3), each holder comprising a pair of spaced band support legs (48) fixed at their upper ends to said second frame (3), a puckering plate (49) to which the lower ends of each of said support legs (48) are fixed, said puckering plates (49) lying parallel to said support legs , said support legs and said puckering plates disposed in planes at right angles to the plane occupied by said second frame (3), four jack screw assemblies (52-55) fixed to said first frame (63) to expand and contract said second frame (3), said jack screws (52) of the jack screw assemblies respectively fixed to said puckering plates (49) of said holders and disposed in a common plane parallel to the plane occupied by said second frame (3), four drive shafts (45) extending one from each jack screw assembly at right angles to the axes of said jack screws (52), a first support means (4), four drive heads (6) rotatably mounted on the first support means (4) engageable by said drive shafts (45), first drive means (34-43) on the first support means (4) to rotate the four drive heads (6), a second support means (26), elevating means (screws 30) connecting said first and second support means whereby the second support means is raisable and lowerable relative to the first support means, four puckering assemblies (belts 5 and support pulleys) mounted on the second support means (26), a puckering belt (5) on each puckering assembly extending between a pair of said band support legs (48) and bearing on a puckering plate (49), second drive means (14-18) on said second support means to simultaneously drive all of said puckering belts (5) and said elevating means (screws 30).

2. Stretch wrapping apparatus as claimed in claim 1 wherein the second frame (3) comprises four members (46,47) each with two legs at right angles with telescopic engagement between the ends of the legs of the adjacent members.

3. Stretch wrapping apparatus as claimed in claim 1 wherein the puckering belt (5) of each puckering assembly is supported on a pair of pulleys (**21,21*a*) connected to the second support means (26) through a parallel link assembly (23-25) enabling the puckering belt to mvoe towards and away from its associated puckering plate (49**).

4. Stretch wrapping apparatus as claimed in claim 1 wherein the elevating means comprises three threaded members (30) engaged in nuts on the first support means (4), bearings (31) on the second support means (26) with the upper ends of the threaded members (30) mounted in the bearings (31) to allow rotary but not axial movement relative to the bearings.

5. Stretch wrapping apparatus as claimed in claim 1 in combination with a wheeled transporter (2) for the second frame (3), said transporter having a frame, two telescopic masts (72) on said frame, each mast having an outer part and an inner part, said first frame (63) fixed to two trolleys (76) respectively mounted one on each inner mast part, mast extending and contracting means (64) and trolley moving means.

6. Stretch wrapping apparatus as climed in claim 5 wherein the mast extending and contracting means comprises a motor (64), an endless chain (70) on each mast outer part driven by the motor, a connection (73) between each mast inner part (72) and the chain (70) of its associated mast outer part, and the trolley moving means comprises an endless cable (79) on each inner mast part, a connection between each mast outer part and the cable (79) of its associated inner part and a trolley driving dog (85) on each cable to drive the trolley (76) upwardly and releasable catch means (88) on each trolley engageable with the driving dog (85) when the trolley is to be driven downwardly.

* * * * *